US008162709B2

(12) United States Patent
Boyer et al.

(10) Patent No.: US 8,162,709 B2
(45) Date of Patent: Apr. 24, 2012

(54) PADDLE HAVING A LEVER FOR GENERATING SOUND

(75) Inventors: Réjean Boyer, Laval (CA); Annie Larouche, Mascouche (CA)

(73) Assignee: Pelican International Inc., Laval, Quebec (CA)

( * ) Notice: Subject to any disclaimer, the term of this patent is extended or adjusted under 35 U.S.C. 154(b) by 95 days.

(21) Appl. No.: 12/872,059

(22) Filed: Aug. 31, 2010

(65) Prior Publication Data

US 2012/0052754 A1 Mar. 1, 2012

(51) Int. Cl.
*B63H 16/04* (2006.01)

(52) U.S. Cl. ..... 440/102; 440/101

(58) Field of Classification Search ..... 440/101, 440/102

See application file for complete search history.

(56) References Cited

U.S. PATENT DOCUMENTS

| | | | | |
|---|---|---|---|---|
| 3,529,907 | A | 9/1970 | Akermanis | |
| 4,709,651 | A | 12/1987 | Lance | |
| 5,509,702 | A * | 4/1996 | Warehime et al. | 285/409 |
| D369,627 | S | 5/1996 | Thor | |
| 5,524,892 | A * | 6/1996 | Karp | 473/206 |
| 6,668,428 | B2 | 12/2003 | Moeller | |
| 7,043,802 | B2 | 5/2006 | Moeller et al. | |
| 7,191,779 | B2 | 3/2007 | Shiue | |
| 7,762,246 | B2 * | 7/2010 | Telford | 124/49 |
| 8,091,925 | B2 * | 1/2012 | Sisk | 285/126.1 |
| 2011/0189910 | A1 * | 8/2011 | Sakellarides | 440/101 |

* cited by examiner

*Primary Examiner* — Lars A Olson
*Assistant Examiner* — Andrew Polay

(57) ABSTRACT

A paddle suitable for use with a kayak or like watercraft, the paddle comprising: (a) a tubular shaft extending from a first blade located at a first end to a second blade located at a second end; (b) a sleeve mounted on the tubular shaft, the sleeve having an outer surface; and (c) a lever extending along a curvature from a proximal end to a distal end, the proximal end being pivotably mounted to the sleeve, the lever comprising a lengthwise extending chamber having an opening provided on an upper wall of the lever and a closed end located remote from the opening and wherein the chamber communicates with a passage extending towards an entry located at the distal end, the lever being movable between a first position, wherein the lever is located proximate the outer surface of the sleeve, and a second position, wherein the distal end of the lever is accessible by the mouth of a user for allowing the user to blow in the entry for generating an airstream within the passage and the chamber such that sound is produced when the airstream emerges from the opening.

32 Claims, 5 Drawing Sheets

PADDLE HAVING A LEVER FOR GENERATING SOUND

FIELD OF THE INVENTION

The present invention relates to a paddle having a lever adapted to generate sound as a whistle.

BACKGROUND OF THE INVENTION

Kayaking paddles are generally two-bladed instruments having a shaft connecting two blades that are used intermittently to push against water on either side of a watercraft. Canoeing paddles, on the other hand, are generally single-bladed, comprising a shaft that terminates in a blade on one end and in a handle on the other. While a kayaking paddle is gripped with both hands on the shaft, a canoeing paddle is gripped with one hand on the shaft and the other on the handle. In both cases, it is usually preferable to hold the paddle at a certain distance from the blade(s), and so the shaft of a paddle is preferably sized according to the size of the user's arms. Different styles of paddling and/or boats, also sometimes call for different sizes of paddles.

Adjustable paddles, that is, paddles having adjustable length shafts, are therefore desirable in many instances. Such an instance would be the case of a family with a single kayak but with two or more people using the kayak—for example, a parent and a child. In such a case, a paddle that is suitable for the parent would certainly not be suitable for the child. Another instance where adjustability of the length would be preferable is where kayaks and paddles are rented. In this case, the store must maintain an inventory of various size paddles in order to meet the requirements of the different customers renting the equipment. A further requirement for a kayak paddle is the adjustability of the relative orientation of the blades and the angles. An example of an adjustment mechanism is one where the shaft of the paddle is made of two tubular members, one of which is sized to slide into the other by having over at least a portion of its length a cross-section that fits within the interior of the other member. A locking mechanism holds the two members in place relative to one another.

In addition, a whistle is an essential piece of equipment when partaking in outdoor activity. In water-bound activities and watercraft activity in particular, there is a danger of being lost, losing sight of land, or being swept away from an intended course by winds or current. In any such emergency, a whistle can be used to create a loud noise to signal distress or to attract the attention of potential rescuers. As such, it is generally recommended to have a whistle at all times when engaging in any outdoor or water-bound activity. However, most whistles are small in size and due to their infrequent use, they are easily forgotten, neglected or generally left behind.

Consequently, there is a need in the industry for a whistle that is integrated in a paddle suitable for use with a kayak or like watercraft.

SUMMARY OF THE INVENTION

According to a first aspect, the present invention provides an adjustable paddle suitable for use with a kayak or like watercraft, the paddle extending along a longitudinal axis and comprising: (a) a first paddle member, the first paddle member having a first blade and a first tubular shaft extending from the first blade and having a first end portion provided with a longitudinal slit; (b) a second paddle member, the second paddle member having a second blade and a second tubular shaft extending from the second blade and having a second end portion that is engageable within the first end portion; (c) a sleeve mounted on the first end portion, the sleeve comprising a longitudinal slit located above the longitudinal slit of the first end portion; and (d) a lever extending along a curvature from a proximal end to a distal end, the proximal end being pivotably mounted on the sleeve, the lever comprising a lengthwise extending chamber having an opening provided on an upper wall of the lever and a closed end located remote from the opening and wherein the chamber communicates with a passage extending towards an entry located at the distal end; wherein the lever is movable between a first position, wherein the lever exerts pressure on the sleeve for closing the slits of the first end portion and sleeve such that the first and second paddle members are secured together, and a second position, wherein the lever no longer exerts pressure on the sleeve for allowing either one or both longitudinal and rotational movements of the second paddle member relative to the first paddle member such that length of the paddle and orientation of the second blade relative to the first blade can be adjusted by a user; and wherein, in the second position, the distal end of the lever is accessible by the mouth of the user for allowing the user to blow in the entry for generating an airstream within the passage and the chamber such that sound is produced when the airstream emerges from the opening.

According to a second aspect, the invention further provides a paddle suitable for use with a kayak or like watercraft, the paddle comprising: (a) a tubular shaft extending from a first blade located at a first end to a second blade located at a second end; (b) a sleeve mounted on the tubular shaft, the sleeve having an outer surface; and (c) a lever extending along a curvature from a proximal end to a distal end, the proximal end being pivotably mounted to the sleeve, the lever comprising a lengthwise extending chamber having an opening provided on an upper wall of the lever and a closed end located remote from the opening and wherein the chamber communicates with a passage extending towards an entry located at the distal end, the lever being movable between a first position, wherein the lever is located proximate the outer surface of the sleeve, and a second position, wherein the distal end of the lever is accessible by the mouth of a user for allowing the user to blow in the entry for generating an airstream within the passage and the chamber such that sound is produced when the airstream emerges from the opening.

This and other aspects and features of the present invention will now become apparent to those of ordinary skill in the art upon review of the following description of specific embodiments of the invention and the accompanying drawings.

BRIEF DESCRIPTION OF THE DRAWINGS

A detailed description of embodiments of the present invention is provided hereinbelow with reference to the following drawings, in which.

Figure 1:
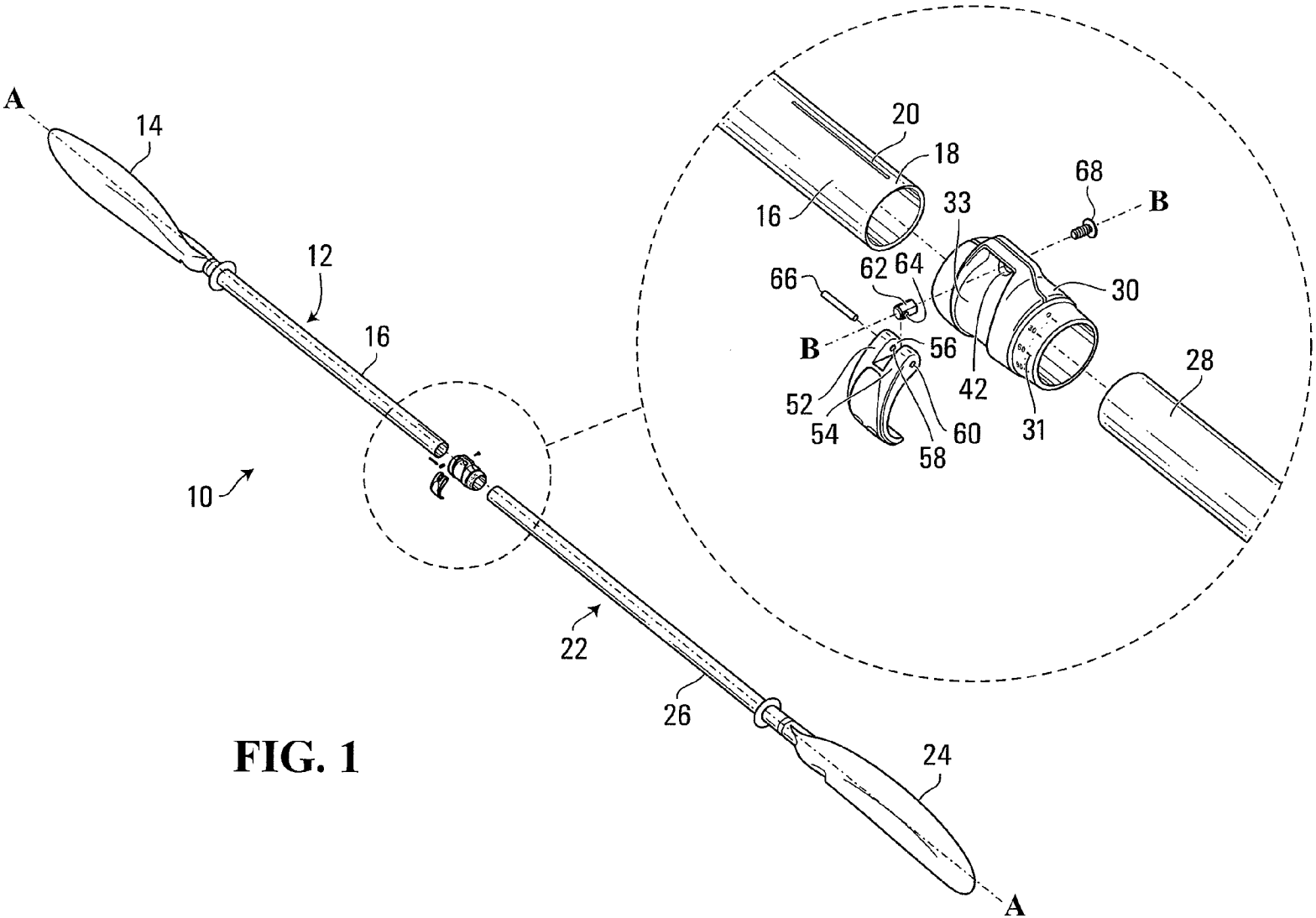
FIG. 1 is a perspective exploded view of an adjustable paddle in accordance with a first embodiment of present invention with an enlarged view of the adjustment mechanism and tubular shafts.

In the drawings, embodiments of the invention are illustrated by way of example. It is to be expressly understood that the description and drawings are only for purposes of illustration and as an aid to understanding, and are not intended to be a definition of the limits of the invention.

DETAILED DESCRIPTION OF THE EMBODIMENTS OF THE INVENTION

To facilitate the description, any reference numeral designating an element in one figure will designate the same element if used in any other figures. In describing the embodiments, specific terminology is resorted to for the sake of clarity but the invention is not intended to be limited to the specific terms so selected, and it is understood that each specific term comprises all equivalents.

Unless otherwise indicated, the drawings are intended to be read together with the specification, and are to be considered a portion of the entire written description of this invention. As used in the following description, the terms "horizontal", "vertical", "left", "right", "up", "down" and the like, as well as adjectival and adverbial derivatives thereof (e.g., "horizontally", "rightwardly", "upwardly", "radially", etc.), simply refer to the orientation of the illustrated structure. Similarly, the terms "inwardly," "outwardly" and "radially" generally refer to the orientation of a surface relative to its axis of elongation, or axis of rotation, as appropriate.

Figure 2:
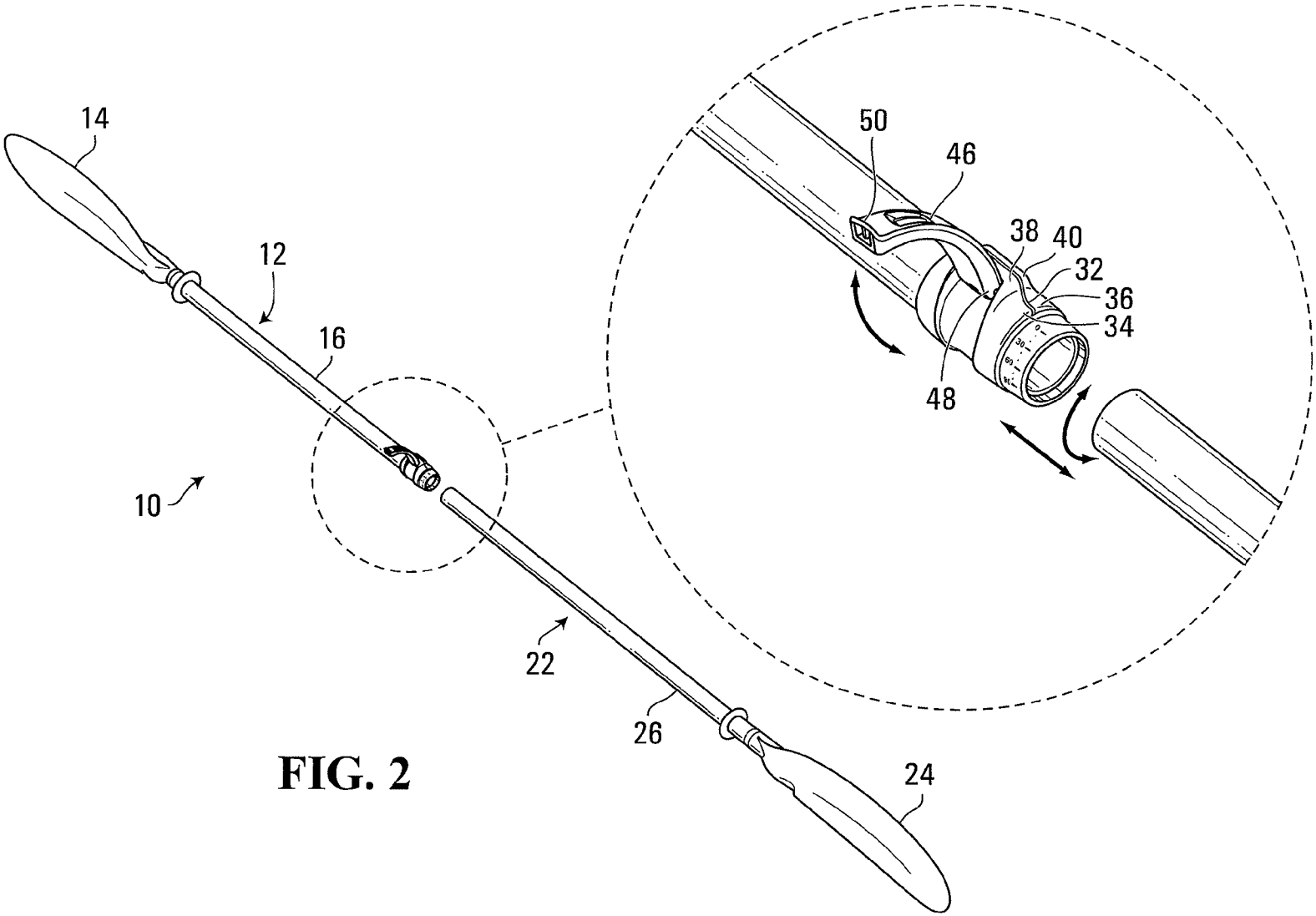
FIG. 2 is a perspective view of the adjustable paddle of FIG. 1 with an enlarged view of the adjustment mechanism.

FIGS. 1 and 2 shows an adjustable paddle 10 suitable for use with a kayak or like watercraft, the paddle extending along a longitudinal axis A-A.

The adjustable paddle 10 has a first paddle member 12 having a first blade 14 and a first tubular shaft 16 extending from the first blade 14. The first tubular shaft 16 has a first end portion 18 provided with a longitudinal slit 20.

The adjustable paddle 10 also comprises a second paddle member 22 having a second blade 24 and a second tubular shaft 26 extending from the second blade 24. The second tubular shaft 26 has a second end portion 28 that is engageable within the first end portion 18. To that effect, the internal diameter of the first end portion 18 could be slightly larger than the external diameter of the second end portion 28 such that the second end portion 28 can be tightly inserted in the first end portion 18. For example, where the first tubular shaft 16 may have an internal diameter of 26 mm, the second tubular shaft 26 may have an external diameter that is slightly smaller than 26 mm.

The first and second tubular shafts 16, 26 may be made of carbon, fiberglass or aluminum.

The first and second blades 14, 24 may be made of reinforced fiberglass.

The adjustable paddle 10 further comprises a sleeve 30 mounted on the first end portion 18 of the first tubular shaft 16. To that effect, the internal diameter of the sleeve 30 could be slightly larger than the external diameter of the first end portion 18 such that the first end portion 18 can be tightly inserted in sleeve 30. For example, the sleeve 30 may have an internal diameter of 30 mm while the first tubular shaft 16 may have an external diameter slightly smaller than 30 mm, such as 26 mm The sleeve 30 can be joined, bonded, affixed or glued to the first tubular shaft 16.

The sleeve 30 comprises a longitudinal slit 32 located above the longitudinal slit 20 of the first end portion 18. The sleeve 30 has two opposing longitudinal walls 34, 36 defining therebetween the slit 32. The opposed walls 34, 36 also have projections 38, 40 extending upwardly therefrom and comprising apertures 42, 44 (not shown) that extend along an axis B-B that is perpendicular relative to the longitudinal axis A-A.

The sleeve 30 has angle indicators 31 for indicating the angle of the second blade 24 with respect to the first blade 14. These indicators can be formed of numbers, lines or dots. In one embodiment, the indicators 31 comprise the numbers 0, 30, 60 and 90 with corresponding lines and dots between two lines to indicate 10° increments.

The adjustable paddle 10 also comprises a lever 46 extending along a curvature from a proximal end 48 to a distal end 50. The proximal end 48 of the lever 46 has first and second legs 52, 54, defining a space 56 therebetween. The first and second legs 52, 54 also have first and second channels 58, 60 that extend parallel to the longitudinal axis A-A.

The adjustable paddle 10 further comprises a head 62 that is mounted in the space 56 and having a threaded hole extending along the perpendicular axis B-B. The head comprises a longitudinal channel 64 whose axis is parallel to the axis A-A. A rod 66 can be located in the first and second channels 58, 60 of the first and second legs 52, 54 and in the longitudinal channel 64 of the head 62 for pivotably mounting the lever 46 from a first position as shown in FIG. 3A to a second position as shown in FIG. 3B.

Figure 3B:
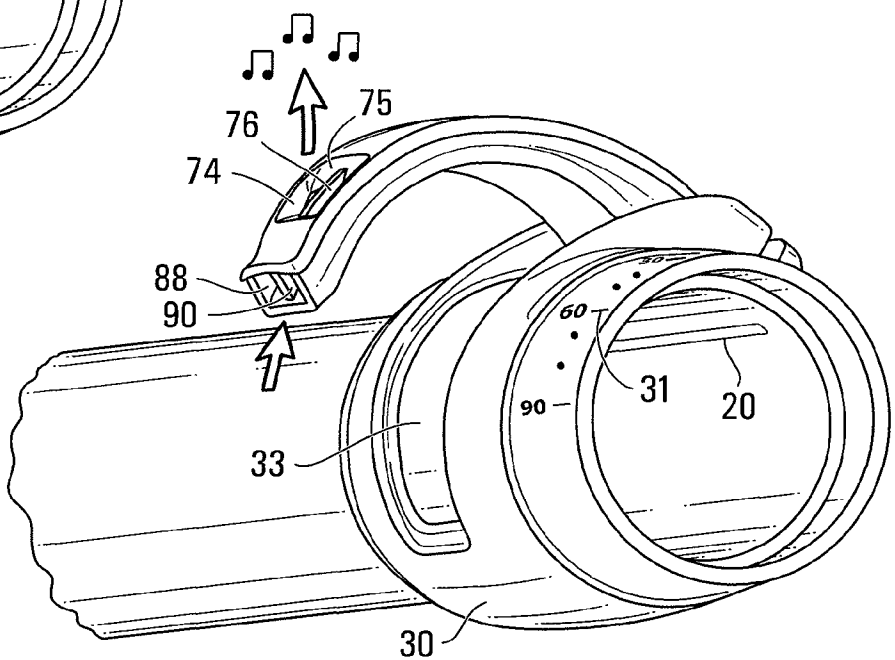
FIG. 3B is a perspective enlarged view of the adjustment mechanism shown in a second position
Figure 3A:
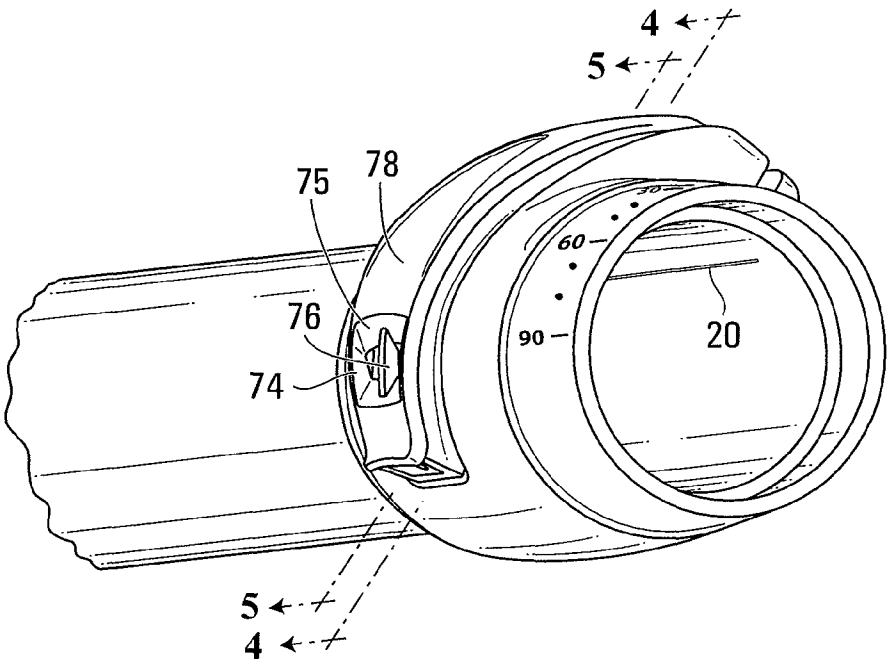
FIG. 3A is a perspective enlarged view of the adjustment mechanism shown in a first position.

The adjustable paddle 10 further comprises a threaded fastener 68 located in the apertures 42, 44 of the projections 38, 40 and being engaged in the threaded hole of the head 62 for affixing the lever 46 to the sleeve 30 as shown in FIGS. 2, 3A and 3B.

In the first position shown in FIG. 3A, the lever 46 exerts pressure on the sleeve 30 for closing the slits 20, 32 such that the first and second paddle members 12, 22 are secured together.

FIG. 3A shows that when the lever 46 is in its first position, it is received within a recess 33 formed on the outer surface of the sleeve 30, which is best shown in FIGS. 1 and 3B. The internal surfaces of the recess 33 are generally shaped to correspond to the surfaces of the bottom portion of the lever 46 with which it will register. Furthermore, the surfaces of the recess 33 in the general area of the aperture 42 that receives the proximal end 48 is typically shaped to accommodate the first and second legs 52, 54 regardless of whether the lever 46 is in either the first or second position.

As the lever 46 is moved from the second to the first position, the first and second legs 52, 54 are brought into increasing contact with the corresponding surface of the projection 38. Because the lever 46 is affixed to the sleeve 30 via the threaded fastener 68, the head 62 and the rod 66, the force generated by this increasing contact causes the projection 38 to be moved toward the opposed projection 40 across the longitudinal slit 32. At the same time, the opposed longitudinal walls 34, 36 from which these projections originate are also moved towards each other as a result of this increased contact.

As the lever 46 continues to move to its first position causing the opposed walls 34, 36 to move towards each other, the distance between them decreases, which also closes the longitudinal slits 20 and 32. Moreover, because the first and second end portions 18 and 28 were previously tightly inserted in the space between the walls 34, 36, the decrease in the space between these walls causes increasing pressure to be exerted by the sleeve 30 on the first and second paddle members 12, 22. This exerted pressure helps secure these members together, thus allowing the adjustable paddle 10 to be used to propel a watercraft.

When the lever 46 is moved from the first position to the second position shown in FIG. 3B, this process is reversed. Specifically, contact between the first and second legs 52, 54 and the corresponding surface of the projection 38 decreases until the lever 46 reaches its second position, which causes the opposed projections 38 and 40 (and the opposed longitudinal walls 34, 36 from which they are formed) to separate, thus reopening the longitudinal slits 20 and 32. In addition, pressure exerted by the sleeve 30 on the first and second end portions 18 and 28 is reduced as the distance between the opposed walls 38 and 40 increases, which allows longitudinal and rotational movements of the second paddle member 22 relative to the first paddle member 12 such that adjustments of the overall length of the adjustable paddle 10 and/or the orientation of the second blade 24 relative to the first blade 14 can be performed by a user. The range of length adjustment of the paddle may be of at least 5 cm.

It will be understood that in another embodiment wherein one of the shafts 16, 26 cannot rotate relative to the other, the user may only be provided with the ability to make length adjustments to the paddle. In a further embodiment wherein no longitudinal movement of one of the shafts 16, 26 relative to the other is possible, the user may only be provided with the ability to adjust the orientation of the second blade relative to the first blade.

The lever 46 comprises first and second lengthwise-extending chambers 70, 72 that are arranged in a side-by-side relationship. FIGS. 3A, 3B, 4 and 5 show that the chambers 70, 72 have respective first and second openings 74, 76 provided on an upper wall 78 of the lever 46. The chambers 70, 72 also have first and second closed ends 80, 82 that are located remote from the first and second openings 74, 76. Moreover, the first and second chambers 74, 76 communicate with first and second passages 84, 86 extending towards first and second entries 88, 90 located at the distal end 50 of the lever 46.

Figure 5:
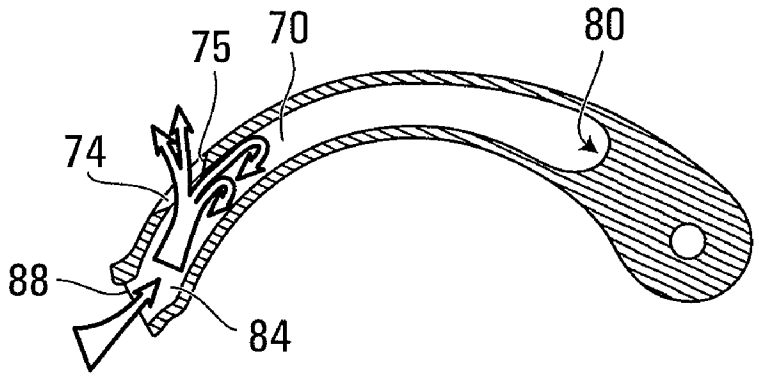
FIG. 5 is a cross-sectional view taken along the axis 5-5.
Figure 4:
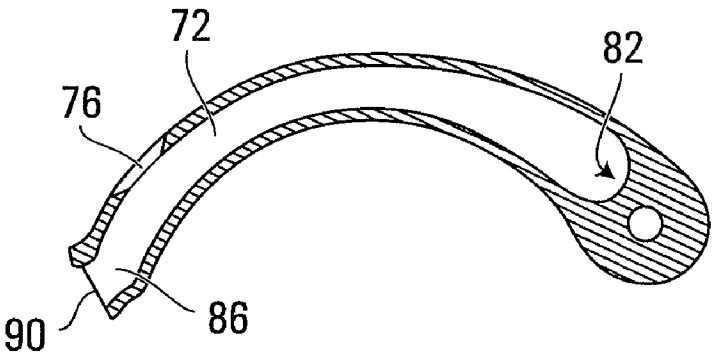
FIG. 4 is a cross-sectional view taken along the axis 4-4.

Each of the first and second chambers 70, 72 may have a substantially rectangular cross-sectional shape. FIGS. 4 and 5 show the cross-sectional shape of the chambers 70, 72 along the respective axes 4-4 and 5-5 that are shown in FIG. 3A.

The cross-sectional size of each first and second chambers 70, 72 may gradually increase in a direction towards their first and second closed ends 80, 82. The length of one of the chambers 70, 72 may be different from the length of the other of the chambers 70, 72. For example, the length of chamber 70 may be different from chamber 72, as can be seen in FIGS. 4A and 4B.

Each of the first and second passages 84, 86 may have a substantially rectangular cross-sectional shape. The cross-sectional size of each of the first and second passages 84, 86 may gradually reduce in a direction away from the first and second entries 88, 90.

As shown best by FIG. 3B, when the lever 46 is in the second position, its distal end 50 is accessible to the mouth of the user for allowing the user to blow air into the first and second entries 88, 90 for generating two separate airstreams passing through the first and second passages 84, 86, across the first and second chambers 70, 72 and emerging from the first and second openings 74, 76 so that sound is produced simultaneously by the first and second chambers 70, 72.

In particular, when the user blows air into the first and second entries 88, 90, the airflow that enters the first and second passages 84, 86 encounters the first and second openings 74, 76. These openings, and in particular, the inclined lateral wall 75 that is opposed to the direction of the airflow, cause the airflow to be split between a first portion that continues into the chambers 70, 72 and a second portion that exits via the openings 74, 76 as best shown in FIG. 5.

The split in the airflow causes a turbulent vortex to be generated in the area above the inclined lateral wall 75 and in the chambers 70, 72 that typically imparts a vibration at a particular frequency to the incoming portion of the airflow (i.e., the air which is currently entering the first and second chambers 70, 72), as well as to the portion of the airflow that is currently emerging from the openings 74, 76. When the incoming portion of the airflow encounters the first and second closed ends 80, 82, the shape of these ends cause an outgoing portion of the airflow to be forced back towards the openings 74, 76.

Because the vibration induced in the incoming and outgoing portions of the airflow are likely at or about the same frequency, the first and second chambers 70, 72 may become acoustically resonant and thus generate a sound wave at a particular frequency within these chambers. This resulting sound wave subsequently causes the air above the first and second openings 74, 76 to also vibrate at a frequency that is likely similar to the frequency in the chambers 70, 72, as well as to the frequency of the existing airflow, which may further enhance the sound generated by the lever 46. The sound generated by this sound wave is represented by the musical notes shown in FIG. 3B.

In general, the frequency of the sound wave generated by the user blowing air into the distal end 50 of the lever 46 falls within the range of human hearing, namely between 20 Hz and 20 KHz. In an embodiment, the frequency of this sound wave may be in the range of 180 Hz to 2100 Hz. Those skilled in the art will appreciate that other frequency ranges are possible and would fall within the scope of the present invention.

Because the length of the chambers 70, 72 are different, the frequency of the sound thus produced by each chamber may be somewhat different. For example, a chamber with a shorter length (e.g., the chamber 70 shown in FIG. 4) may produce a higher-frequency sound than the other chamber with a longer length (e.g., the chamber 72 shown in FIG. 5).

In an alternative embodiment, the frequency of the sound produced by the lever 46 may not depend on the length of the first and second chambers 70, 72. Instead, the frequency of the sound may be determined by differences in the size and configuration of the first and second openings 74, 76. Therefore, one of the openings (such as the opening 74) may be configured to produce sound with a higher frequency than the other opening (such as the opening 76).

Figure 6:
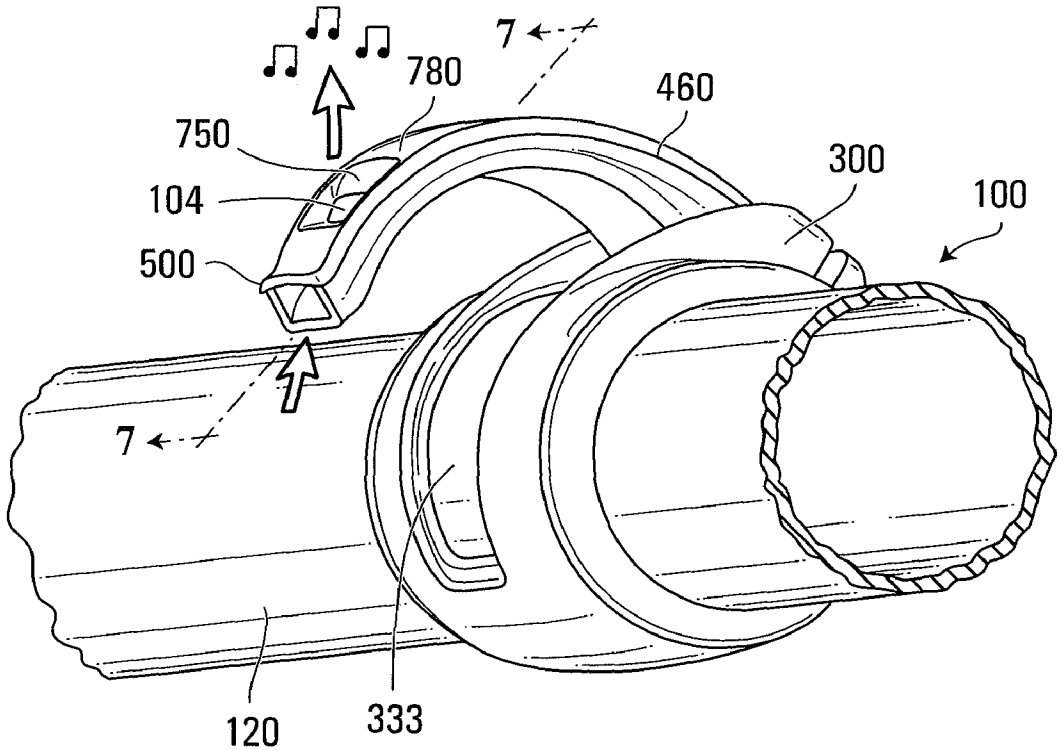
FIG. 6 is a perspective enlarged view of a paddle in accordance with a second embodiment of the present invention.
Figure 7:
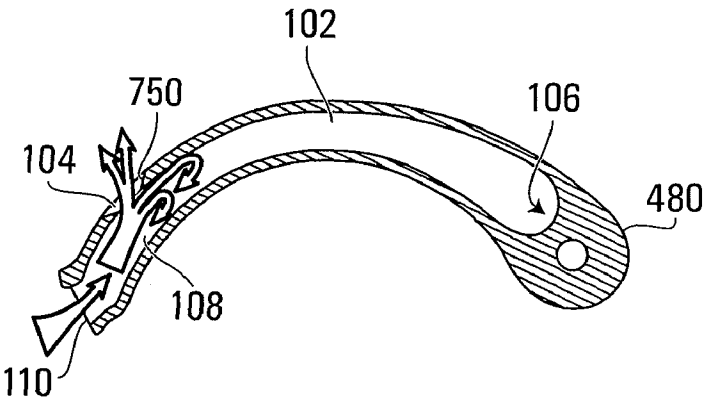
FIG. 7 is a cross-sectional view taken along the axis 7-7.

FIGS. 6 and 7 show another embodiment of a paddle 100 in accordance with the present invention. The paddle 100 is also suitable for use with a kayak or like watercraft and has a tubular shaft 120 extending from a first blade located at a first end to a second blade located at a second end. Since the paddle 100 is made of a single tubular shaft 120, neither length adjustment of the paddle nor adjustments of the second blade relative to the first blade are available. The paddle also comprises a sleeve 300 mounted on the tubular shaft 120. The sleeve 300 can be joined, bonded, affixed or glued to the tubular shaft 120. The sleeve has an outer surface with a recess 333.

The paddle 100 further comprises a lever 460 extending along a curvature from a proximal end 480 to a distal end 500, the proximal end 480 being pivotably mounted to the sleeve 300.

As best shown in FIG. 7, the lever 460 comprises a lengthwise extending chamber 102 having an opening 104 provided on an upper wall 780 of the lever 460 and a closed end 106 located remote from the opening 104 and wherein the chamber 102 communicates with a passage 108 extending towards an entry 110 located at the distal end 500. The lever 460 is movable between a first position and a second position.

In the first position, the lever is located proximate the outer surface of the sleeve 300. To this effect, the lever 460 may have an inner surface with a curvature that generally follows the one of the outer surface of the sleeve 300 such that this inner surface generally conforms to the outer surface of the sleeve 300 in the first position. Likewise, the curvature of the lever 460 may generally follow the one of the sleeve 300 and/or of the tubular shaft 120 such that the lever generally conforms to the sleeve 300 in the first position. It is understood that, when the lever 460 is in the first position, the lever 460 should be in a position relative to the sleeve 300 and/or tubular shaft 120 wherein movements of the hands of the user relative to the paddle are not substantially impeded. In another embodiment, a portion of the lever 460 may register within the recess 333 of the sleeve 300 (similarly as the lever 46 partially registers within the recess 33 as shown in FIG. 3A).

In the second position, the distal end 500 of the lever 460 is accessible by the mouth of the user for allowing the user to blow in the entry 110 for generating an airstream within the passage 108 and the chamber 102 such that sound is produced when the airstream emerges from the opening 104.

As discussed above, when the user blows air into the entry 110, the airflow that enters the passage 108 encounters opening 104. The opening 104, and in particular the inclined lateral wall 750 that is opposed to the direction of the airflow, causes the airflow to be split between a first portion that continues into the chambers 102 and a second portion that exits via the opening 104 as best shown in FIG. 7.

The split in the airflow causes a turbulent vortex to be generated in the area above the inclined lateral wall 750 and in the chamber 102 that typically imparts a vibration at a particular frequency to the incoming portion of the airflow (i.e., the air which is currently entering the chamber 102), as well as to the portion of the airflow that is currently emerging from the 104. When the incoming portion of the airflow encounters the closed end 106, the shape of this end causes an outgoing portion of the airflow to be forced back towards the opening 104.

Because the vibration induced in the incoming and outgoing portions of the airflow are likely at or about the same frequency, the chamber 102 may become acoustically resonant and thus generates a sound wave at a particular frequency within the chamber 102. This resulting sound wave subsequently causes the air above the opening 104 to also vibrate at a frequency that is likely similar to the frequency in the chamber 102, as well as to the frequency of the existing airflow. The sound generated by this sound wave is represented by the musical notes shown in FIG. 6.

In general, the frequency of the sound wave generated by the user blowing air into the distal end 500 of the lever 460 falls within the range of human hearing, namely between 20 Hz and 20 KHz. In an embodiment, the frequency of this sound wave may be in the range of 180 Hz to 2100 Hz. Those skilled in the art will appreciate that other frequency ranges are possible and would fall within the scope of the present invention.

The chamber 102 may have a substantially rectangular cross-sectional shape. The cross-sectional size of the chamber 102 may gradually increase in a direction towards the closed end 106. The passage 108 may have a substantially rectangular cross-sectional shape. The cross-sectional size of the passage 108 may gradually reduce in a direction away from the entry 110.

Although various embodiments have been illustrated, this was for the purpose of describing, but not limiting, the invention. Various modifications will become apparent to those skilled in the art and are within the scope of this invention, which is defined more particularly by the attached claims.

The invention claimed is:

1. An adjustable paddle suitable for use with a kayak or watercraft, said paddle extending along a longitudinal axis and comprising:

(a) a first paddle member, said first paddle member having a first blade and a first tubular shaft extending from said first blade and having a first end portion provided with a longitudinal slit;

(b) a second paddle member, said second paddle member having a second blade and a second tubular shaft extending from said second blade and having a second end portion that is engageable within said first end portion;

(c) a sleeve mounted on said first end portion, said sleeve comprising a longitudinal slit located above said longitudinal slit of said first end portion; and (d) a lever extending along a curvature from a proximal end to a distal end, said proximal end being pivotably mounted on said sleeve, said lever comprising a lengthwise extending chamber having an opening provided on an upper wall of said lever and a closed end located remote from said opening and wherein said chamber communicates with a passage extending towards an entry located at said distal end;

wherein said lever is movable between a first position, wherein said lever exerts pressure on said sleeve for closing said slits of said first end portion and sleeve such that said first and second paddle members are secured together, and a second position, wherein said lever no longer exerts pressure on said sleeve for allowing either one or both longitudinal and rotational movements of said second paddle member relative to said first paddle member such that length of said paddle and orientation of said second blade relative to said first blade can be adjusted by a user; and wherein, in said second position, said distal end of said lever is accessible by the mouth of the user for allowing the user to blow in said entry for generating an airstream within said passage and said chamber such that sound is produced when said airstream emerges from said opening.

2. An adjustable paddle as defined in claim 1, wherein said chamber, opening, closed end and entry are first chamber, first opening, first closed end and first entry, said lever comprising a second lengthwise extending chamber, said first and second chambers being arranged in a side-by-side relationship, said second chamber having a second opening provided on an upper wall of said lever and a second closed end located remote from said second opening and wherein said second chamber communicates with a second passage extending towards a second entry located at said distal end, and wherein, and said second position, said distal end of said lever is accessible by the mouth of the user for allowing the user to blow in said first and second entries for generating two separate airstreams within said first and second passages and said first and second chambers such that sound is produced simultaneously when said two separate airstreams emerge from said first and second openings.

3. An adjustable paddle as defined in claim 1, wherein said sleeve has angle indicators for indicating an angle of said second blade with respect to said first blade.

4. An adjustable paddle as defined in claim 1, wherein said sleeve has an outer surface with a recess and wherein a portion of said lever registers within said recess of said sleeve in said first position.

5. An adjustable paddle as defined in claim 1, wherein range of length adjustment of said paddle is at least 5 cm.

6. An adjustable paddle as defined in claim 1, wherein said proximal end of said lever has first and second legs defining a space therebetween and wherein said first and second legs have first and second channels extending along the longitudinal axis of the paddle.

7. An adjustable paddle as defined in claim 6, wherein said slit of said sleeve is located between two opposing longitudinal walls of said sleeve and wherein each wall has a projection extending upwardly therefrom and comprising a aperture extending along a perpendicular axis relative to the longitudinal axis of the paddle.

8. An adjustable paddle as defined in claim 7, comprising a head mounted in said space of said first and second legs and having a threaded hole extending along the perpendicular axis and a longitudinal channel and a rod located in said first and second channels of said first and second legs and in said channel of said head for pivotably mounting said lever with respect to said head.

9. An adjustable paddle as defined in claim 8, comprising a threaded fastener located in said apertures of said projections and being engaged in said threaded hole of said head for affixing said lever to said sleeve.

10. An adjustable paddle as defined in claim 1, wherein said chamber has a substantially rectangular cross-sectional shape.

11. An adjustable paddle as defined in claim 1, wherein said passage has a substantially rectangular cross-sectional shape.

12. An adjustable paddle as defined in claim 2, wherein each of said first and second chambers has a substantially rectangular cross-sectional shape.

13. An adjustable paddle as defined in claim 2, wherein cross-sectional size of each first and second chambers gradually increases in a direction towards said first and second closed ends.

14. An adjustable paddle as defined in claim 2, wherein cross-sectional size of each first and second passages gradually reduce in a direction away from said first and second entries.

15. An adjustable paddle as defined in claim 2, wherein said first chamber has a first length and said second chamber has a second length and wherein said first length is different from said second length.

16. An adjustable paddle as defined in claim 1, wherein sound wave of said sound is between 180 Hz and 2100 Hz.

17. An adjustable paddle as defined in claim 2, wherein sound wave of said sound is between 180 Hz and 2100 Hz.

18. An adjustable paddle as defined in claim 1, wherein said first and second tubular shafts are made of carbon, fiberglass or aluminum and said first and second blades are made of reinforced fiberglass.

19. An adjustable paddle as defined in claim 1, wherein said sleeve has an internal diameter of approximately 30 mm.

20. An adjustable paddle as defined in claim 19, wherein said first tubular shaft has an external diameter of approximately 30 mm and an internal diameter of approximately 26 mm.

21. An adjustable paddle as defined in claim 20, wherein said second tubular shaft has an external diameter of approximately 26 mm.

22. A paddle suitable for use with a kayak or watercraft, said paddle comprising:

(a) a tubular shaft extending from a first blade located at a first end to a second blade located at a second end;

(b) a sleeve mounted on said tubular shaft, said sleeve having an outer surface; and (c) a lever extending along a curvature from a proximal end to a distal end, said proximal end being pivotably mounted to said sleeve, said lever comprising a lengthwise extending chamber having an opening provided on an upper wall of said lever and a closed end located remote from said opening and wherein said chamber communicates with a passage extending towards an entry located at said distal end, said lever being movable between a first position, wherein said lever is located proximate said outer surface of said sleeve, and a second position, wherein said distal end of said lever is accessible by the mouth of a user for allowing the user to blow in said entry for generating an airstream within said passage and said chamber such that sound is produced when said airstream emerges from said opening.

23. A paddle as defined in claim 22, wherein said chamber, opening, closed end and entry are first chamber, first opening, first closed end and first entry, said lever comprising a second lengthwise extending chamber, said first and second chambers being arranged in a side-by-side relationship, said second chamber having a second opening provided on an upper wall of said lever and a second closed end located remote from said second opening and wherein said second chamber communicates with a second passage extending towards a second entry located at said distal end, and wherein, and said second position, said distal end of said lever is accessible by the mouth of the user for allowing the user to blow in said first and second entries for generating two separate airstreams passing through said first and second passages for generating two separate airstreams within said first and second passages and said first and second chambers such that sound is produced simultaneously when said two separate airstreams emerge from said first and second openings.

24. A paddle as defined in claim 22, wherein said chamber has a substantially rectangular cross-sectional shape.

25. A paddle as defined in claim 22, wherein said passage has a substantially rectangular cross-sectional shape.

26. A paddle as defined in claim 23, wherein each of said first and second chambers has a substantially rectangular cross-sectional shape.

27. A paddle as defined in claim 23, wherein cross-sectional size of each first and second chambers gradually increases in a direction towards said first and second closed ends.

28. A paddle as defined in claim 23, wherein said first chamber has a first length and said second chamber has a second length and wherein said first length is different from said second length.

29. A paddle as defined in claim 22, wherein sound wave of said sound is between 180 Hz and 2100 Hz.

30. A paddle as defined in claim 23, wherein sound wave of said sound is between 180 Hz and 2100 Hz.

31. A paddle as defined in claim 22, wherein said tubular shaft is made of carbon, fiberglass or aluminum and said first and second blades are made of reinforced fiberglass.

32. A paddle as defined in claim 22, wherein said outer surface of said sleeve has a recess and wherein a portion of said lever registers within said recess of said sleeve in said first position.

* * * * *